US005748033A

United States Patent [19]

Kaveh et al.

[11] Patent Number: 5,748,033

[45] Date of Patent: May 5, 1998

[54] DIFFERENTIAL POWER BUS COMPARATOR

[75] Inventors: Golnaz Kaveh; Gregory F. Taylor, both of Portland; Jeffrey E. Smith, Aloha, all of Oreg.

[73] Assignee: Intel Corporation, Santa Clara, Calif.

[21] Appl. No.: 621,652

[22] Filed: Mar. 26, 1996

[51] Int. Cl.[6] ..... G05F 3/02

[52] U.S. Cl. ..... 327/545; 327/321; 327/327; 327/328; 327/546

[58] Field of Search ..... 327/306, 313, 327/321, 327, 328, 124

[56] References Cited

U.S. PATENT DOCUMENTS

| | | | |
|---|---|---|---|
| 4,617,473 | 10/1986 | Bingham | 327/63 |
| 4,647,848 | 3/1987 | Barrett | 327/313 |
| 4,654,829 | 3/1987 | Jiang et al. | 365/225.7 |
| 4,806,789 | 2/1989 | Sakihama et al. | 327/543 |
| 5,049,841 | 9/1991 | Cooper et al. | 327/328 |
| 5,157,291 | 10/1992 | Shimoda | 327/408 |
| 5,333,093 | 7/1994 | Krautschneider et al. | 327/328 |
| 5,410,192 | 4/1995 | Yamada | 327/408 |
| 5,493,244 | 2/1996 | Pathak et al. | 327/313 |
| 5,600,277 | 2/1997 | Koelling | 327/407 |

*Primary Examiner*—Terry Cunningham

*Attorney, Agent, or Firm*—Blakely, Sokoloff, Taylor & Zafman

[57] ABSTRACT

A method and an apparatus for generating an output voltage for an integrated circuit having multiple power supplies. A comparator circuit is coupled to receive power supply lines from the power bus of an integrated circuit. The power supply lines received from the power bus have different voltages which may vary depending on the particular application. The comparator compares the voltage potentials present on the power supply lines and determines which power supply line carries a voltage having the highest potential. The comparator then generates a corresponding select signal wherein the value of the select signal indicates which particular power supply line has the highest voltage potential. A multiplexor is coupled to receive the select signal as well as the power supply lines from the power bus. Based on the value of the select signal, the multiplexor generates the output voltage in response to the select signal wherein the output voltage is substantially equal to the voltage potential of the power supply line having the highest voltage potential.

11 Claims, 4 Drawing Sheets

← FIGURE 4A

DIFFERENTIAL POWER BUS COMPARATOR

BACKGROUND OF THE INVENTION

1. Field of the Invention

The present invention relates generally to integrated circuits and more specifically the present invention relates to an integrated circuit having multi-voltage power supplies.

2. Description of Related Art

In order to maintain compatibility with existing circuits designs as well as maximize circuit performance, designers have found it necessary to design many of today's integrated circuits to accommodate signals having a variety of voltage levels. Correspondingly, designers have also found it necessary to design integrated circuits to operate with multiple power supplies having different voltage levels. This trend may be explained by the fact that there is a continuing effort to increase microprocessors speed as well as decrease microprocessor device sizes. To achieve these goals, integrated circuit devices are "scaled" or reduced in dimension. One consequence of this is that gate oxide thicknesses are reduced proportionally. As a result, the amount of voltage that can be tolerated by such devices also decreases. Furthermore, many products such as mobile or notebook computer applications demand microprocessors to draw minimal power. Accordingly, integrated circuit designers have reduced the voltage supplied to integrated circuits such as microprocessor core circuitry, in light of these factors.

However, in order to maintain compatibility with pre-existing circuit designs, such as other chips that may be found in a computer system, designers must also provide power supplies having different voltage levels to some portions of modern integrated circuits. For example, in view of the factors described above, the input/output (I/O) chips in a computer system may run at a first voltage while the core circuitry of a microprocessor may run at a second voltage such that the second voltage is different than the first voltage. In many cases, the second voltage is less than the first voltage because of the continuing efforts to decrease microprocessor power consumption and device size.

In this example, the microprocessor is generally required to receive both the first and second voltages. The first voltage is generally used to power the periphery circuitry of the microprocessor in order for the microprocessor to communicate reliably with the I/O chips in the computer system. The second voltage supplied to the microprocessor is generally used to power the core circuitry of the microprocessor.

Continuing with the example discussed above, there may be instances where this second voltage may actually be greater than the first voltage. In this situation, integrated circuit designers may actually raise the value of the second voltage in an effort to increase core microprocessor speed and performance. Thus, microprocessor designers must design these integrated circuits with the ability to accommodate both situations where the second voltage may be either less than or greater than the first voltage.

Another problem circuit designers must address is that integrated circuit inputs must be designed to accommodate input signals which may be at a voltage higher than the integrated circuit input can tolerate. As discussed above, there is a continuing trend to design integrated circuits from lower voltage processes. A consequence of these factors is that the gate oxides of low voltage process integrated circuit inputs risk being destroyed by high voltage input signals received from other higher voltage I/O chips in the computer system.

FIG. 1 shows a prior art safe input buffer 101. Safe input buffer 101 solves the problem discussed above with respect to the incompatible voltage levels between a low voltage process and an excessively high voltage input signal received from another integrated circuit. Safe input buffer 101 is utilized at integrated circuit inputs having voltage sensitive gate oxides. An input signal is received at pad 103 which is coupled to voltage clamp circuit 104. As shown in FIG. 1, voltage clamp circuit 104 is coupled in series between pad 103 and integrated circuit input buffer 107. In this example, integrated circuit buffer 107 is an inverter including PMOS transistor 106 and NMOS transistor 108. Input buffer 107 is powered by $V_{CC}$ 111 and voltage clamp circuit 104 is powered by $V_{CCP}$ 109.

Assuming an input signal having a potential of 5 volts is received at pad 103 and that 5 volts is excessively high for the gate oxides of input buffer 107, voltage clamp circuit 104 protects the gate oxides of input buffer 107 by clamping the voltage received at pad 103 to $V_{CCP}$ or less. Assuming the voltage at $V_{CCP}$ 109 is compatible with the gate oxides of input buffer 107, the signal received at the gates of transistors 106 and 108 is "safe," and will not destroy the gate oxides of input buffer 107. It is noted that in the example above, $V_{CCP}$ 109 has a voltage potential higher than $V_{CC}$ 111.

Continuing with the example above, assume now that the integrated circuit in which safe input buffer 101 is utilized accommodates changing the voltages of $V_{CCP}$ 109 and $V_{CC}$ 111 such that $V_{CCP}$ 109 is now at a lower voltage potential than $V_{CC}$ 111. In particular, assume that $V_{CCP}$ is about 2.9 volts, $V_{CC}$ is about 3.7 volts and that an input signal comes into pad 103 at about 5 volts. With voltage clamp circuit 104 clamping the input signal to $V_{CCP}$ or less, the voltage applied to the gates of transistors 106 and 108 may only be about 2.2 volts. With the source of transistor 106 at about 3.9 volts, the leakage current and body effects of PMOS transistor 106 may cause an output sampled at node 113 to be incorrect. That is, PMOS transistor 106 may be mistakenly switched on even though it should be switched off. It is noted that this problem is further exacerbated by the fact that integrated circuit buffers commonly have skewed trip points to accommodate noise. That is, instead of the trip point of such a buffer being at mid-voltage, the trip point of such a buffer is higher than mid-voltage for a low-to-high transition. This circumstance makes it highly desirable for the clamp voltage $V_{CCP}$ 109 applied to voltage clamp circuit 104 to be equal to or higher than the voltage potential at $V_{CC}$ 111. If it could be ensured that the voltage at $V_{CCP}$ 109 is equal to or greater than the voltage at $V_{CC}$ 111, the risk of an erroneous output being sampled at node 113 is significantly reduced.

Therefore, what is needed is a device which could output a voltage which is the highest voltage among a number of input voltages. The output voltage would be useful to ensure that the clamp voltage applied to the voltage clamp circuit of a safe input buffer has adequate voltage potential with respect to the power supply of an integrated circuit input buffer. In the situation presented above, such a device would compare the different voltages supplied to the integrated circuit and apply the highest voltage to the voltage clamp circuit. Such a configuration would protect the gate oxides of the integrated circuit input buffer as well as ensure that safe input signals having an adequate trip voltage potential are applied to an integrated circuit input buffer.

SUMMARY OF THE INVENTION

A method and an apparatus for generating an output voltage for an integrated circuit input is disclosed. In one embodiment, a comparator is configured to receive a plurality of voltage potentials wherein the comparator generates a select signal in response to the plurality of voltage potentials. A multiplexor is coupled to receive the select signal and the plurality of voltage potentials wherein the multiplexor is configured to generate the output voltage for the integrated circuit input in response to the select signal. Additional features and benefits of the present invention will become apparent from the detailed description, figures and claims set forth below.

BRIEF DESCRIPTION OF THE DRAWINGS

The present invention is illustrated by way of example and not limitation in the accompanying figures.

DETAILED DESCRIPTION

A method and an apparatus for generating an output voltage for an integrated circuit is disclosed. In the following description, numerous specific details are set forth such as specific devices, voltages, etc. in order to provide a thorough understanding of the present invention. It will be obvious, however, to one having ordinary skill in the art that the specific details need not be employed to practice the present invention. In other instances, well-known material or methods have not been described in detail in order to avoid unnecessarily obscuring the present invention.

As indicated above, integrated circuits such as microprocessors are sometimes being powered by multiple power supplies having different voltages. That is, one portion of a microprocessor may be powered by a first voltage in order to communicate reliably or be compatible with other chips in a computer system. Another portion of the microprocessor may be powered with a lower voltage power supply in order to minimize power consumption as well as increase device density in the microprocessor. In another instance, portions of the microprocessor may be powered by a higher voltage power supply in order to maximize microprocessor speed or clock rate.

To accommodate the existence of multiple power supplies supplied to an integrated circuit, designers have the need to determine whether the voltage potential of one power supply is higher or lower than the voltage potential of another power supply supplied to the integrated circuit. This determination is necessary in order to ensure correct operation of the integrated circuit.

Figure 1:
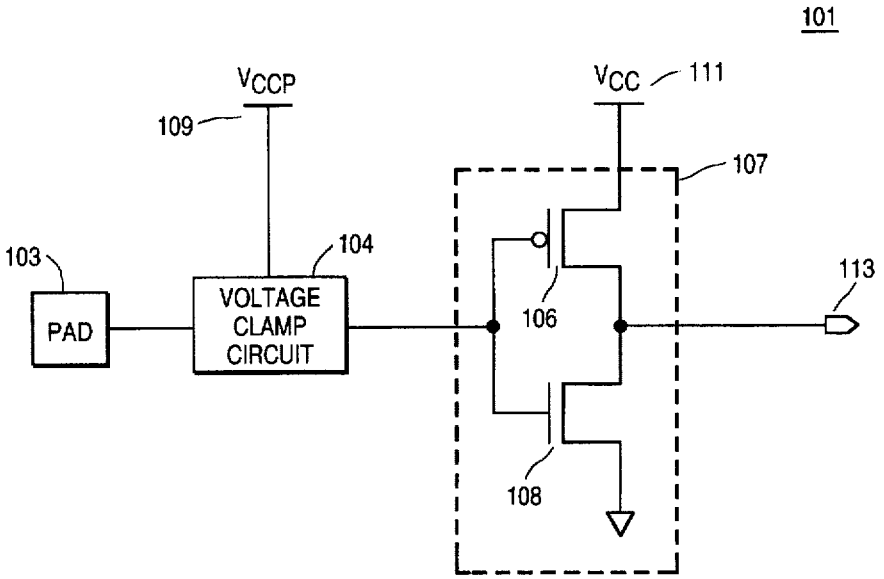
FIG 1 (PRIOR ART)
FIG. 1 illustrates a prior art safe input buffer including an integrated circuit input.
Figure 2:
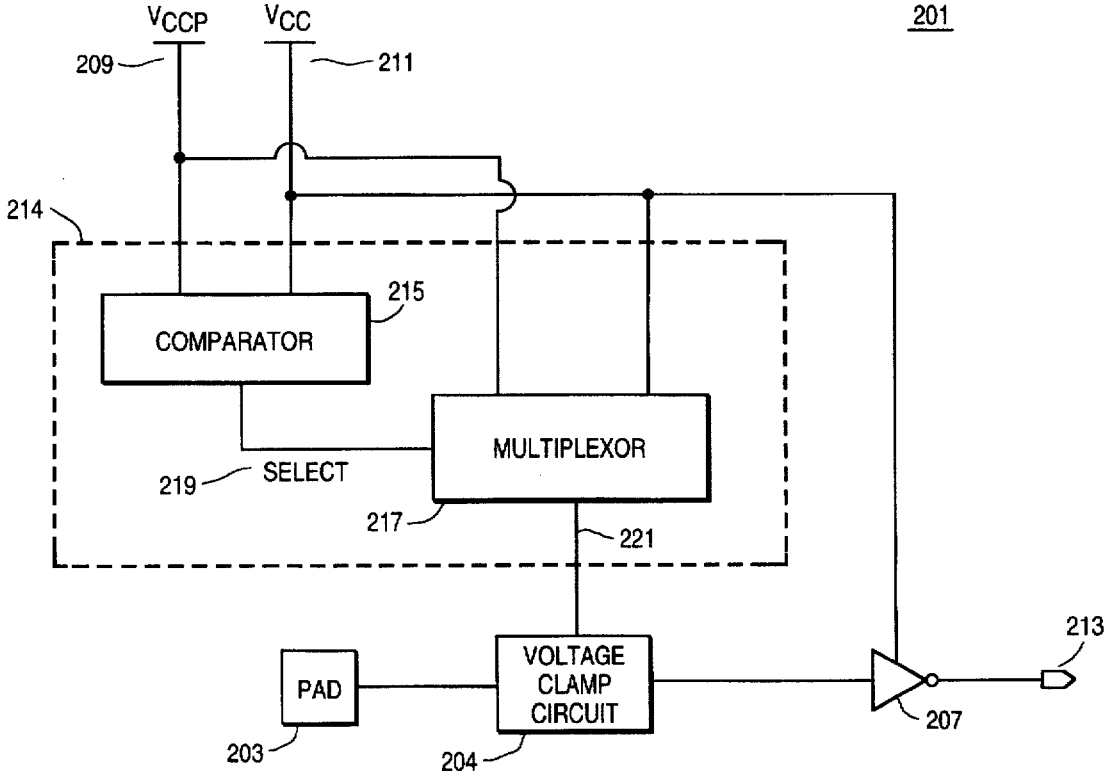
FIG. 2 illustrates a voltage selection circuit in accordance with the teachings of the present invention coupled to a safe input buffer circuit in block diagram form.

In FIG. 2, the present invention is illustrated in block diagram form. In the embodiment shown in FIG. 2, a safe input buffer 201 is shown utilizing the present invention. Safe input buffer 201 is utilized in an integrated circuit with two power supplies, $V_{CC}$ 211 and $V_{CCP}$ 209. In this particular embodiment, the voltage potential of $V_{CCP}$ 209 may be higher or lower than the voltage potential of $V_{CC}$ 211.

In the embodiment shown in FIG. 2, an input signal having voltage potential higher than both $V_{CCP}$ 209 and $V_{CC}$ 211 is received at pad 203. Voltage clamp circuit 204 is coupled between pad 203 and integrated circuit input buffer 207 as shown in FIG. 2. Integrated circuit input buffer 207 is an inverter receiving power from $V_{CC}$ 211. It is appreciated that integrated circuit input buffer 207 is not restricted to be an inverter. That is, other integrated circuit input buffers may be used. The important point to note is that input buffer 207 is powered by $V_{CC}$ 211 and has a trip point between ground and $V_{CC}$. In one embodiment of the present invention, input buffer 207 has a trip point approximately mid-level between ground and $V_{CC}$.

Voltage selection circuit 214 is coupled to receive both power supplies $V_{CCP}$ 209 and $V_{CC}$ 211. Voltage selection circuit 214 compares the received input power supplies and then generates the appropriate corresponding output voltage 221 which is supplied to voltage clamp circuit 204. In one embodiment, output voltage 221 is the larger of $V_{CCP}$ 209 and $V_{CC}$ 211. It is appreciated that the present invention is not limited to receiving only two input power supplies. That is, voltage selection circuit 214 may conceivably be designed to receive any number of input power supplies and generate the appropriate corresponding output voltage 211. Furthermore, it is appreciated that output voltage 211 may be applied to any integrated circuit portion requiring the higher of $V_{CCP}$ 209 or $V_{CC}$ 211. That is, the present invention is not limited to only safe input buffers.

In the embodiment shown in FIG. 2, voltage selection circuit 214 includes comparator 215 coupled to receive $V_{CCP}$ 209 and $V_{CC}$ 211. Comparator 215 compares the voltage potentials of the two input power supplies and generates a select signal 219 which is received by multiplexor 217. Multiplexor 217 is also coupled to receive $V_{CCP}$ 209 and $V_{CC}$ 211. Based on the select signal 219 received from comparator 215, multiplexor 217 generates output voltage 221. The voltage potential of output voltage 221 is substantially equal to the voltage potential of the voltage supply line corresponding with select signal 219.

In safe input buffer 201, voltage selection circuit 214 selects the highest voltage potential between $V_{CCP}$ 209 and $V_{CC}$ 211 and outputs the selected voltage at output voltage 221 to the voltage clamp circuit 204. In so doing, the input signal received at pad 203 is clamped to a voltage potential no more than the voltage potential of output voltage 221. Accordingly, input buffer 207 is protected from dangerously high input voltage potentials. Thus, the risk of destroying the gate oxides of input buffer 207 is reduced. In addition, with the highest voltage between $V_{CCP}$ 209 and $V_{CC}$ 211 being supplied to voltage clamp circuit 204, the safe signal output by clamp circuit 204 to input buffer 207 has sufficient voltage potential to switch input buffer 207 reliably. That is, the voltage output by voltage clamp circuit 204 is sufficiently high to trip correctly input buffer 207.

Figure 3:
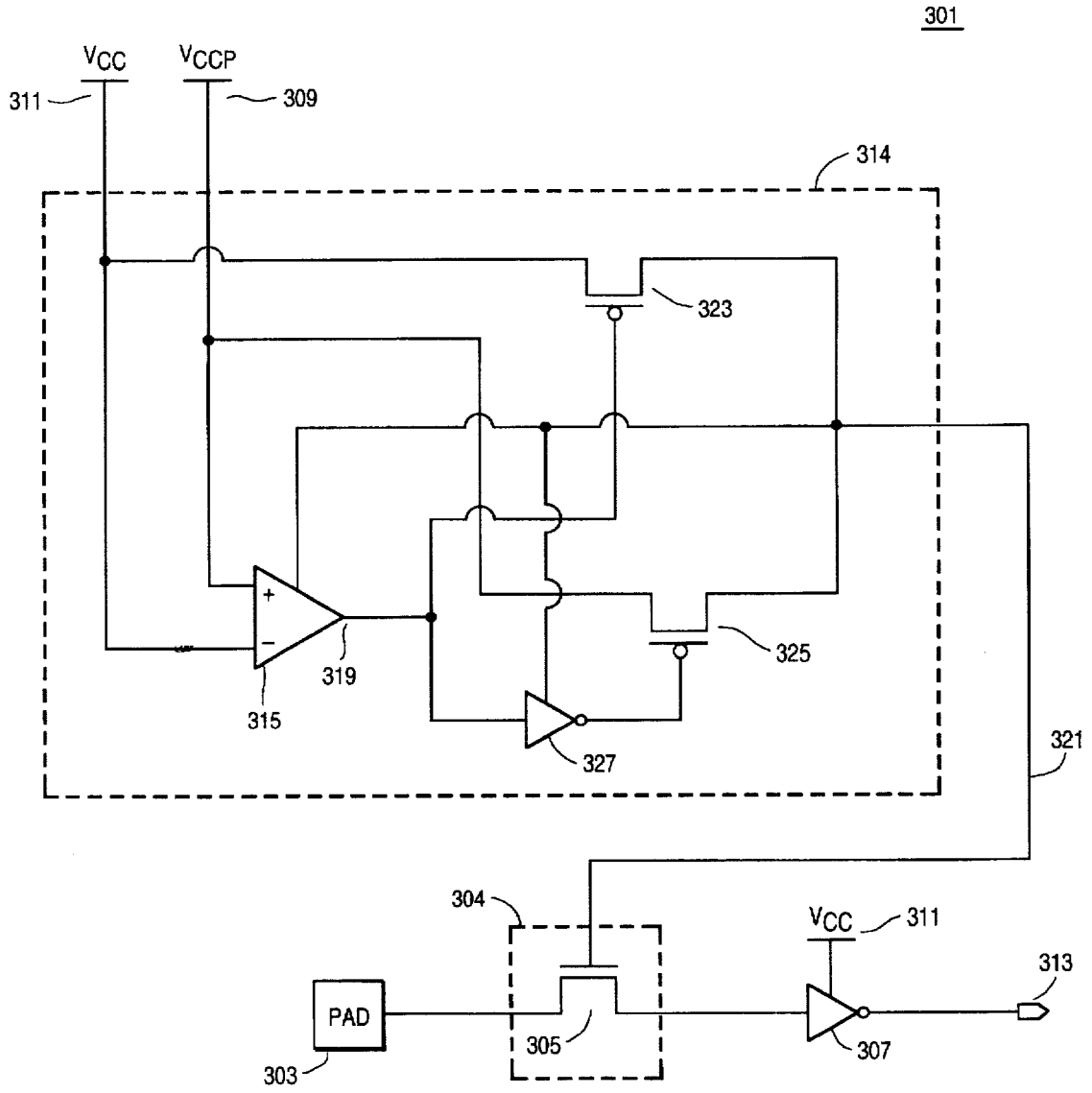
FIG. 3 is a schematic of a voltage selection circuit in accordance with the teachings of the present invention coupled to a safe input buffer.

In FIG. 3, a schematic of a safe input buffer 301 is shown utilizing one embodiment of the present invention. An input signal having a voltage potential higher than a voltage potential of $V_{CC}$ 311 and $V_{CCP}$ 309 is received at pad 303. Voltage clamp circuit 304, including NMOS transistor 305, is coupled between pad 303 and input buffer 307. Input buffer 307 is powered by $V_{CC}$ 311. Accordingly, input buffer 307 has a trip point between ground and the voltage potential of $V_{CC}$ 311. In the described embodiment the trip point of input buffer 307 is approximately mid-level between ground and $V_{CC}$. The described embodiment, however, should also function properly with input buffer 307 having a skewed trip point. That is, the trip point of input buffer 307 does not necessarily need to be at approximately mid-level of ground to $V_{CC}$.

As shown in FIG. 3, voltage selection circuit 314 supplies output voltage 321 to the gate of transistor 305 of voltage clamp circuit 304. Voltage selection circuit 314 functions as a differential power bus comparator. $V_{CC}$ 311 and $V_{CCP}$ 309 of the integrated circuit power bus (not shown) are received by comparator 315 of voltage selection circuit 317. Comparator 315 compares the voltage potential of $V_{CC}$ 311 with the voltage potential of $V_{CCP}$ 309.

In the embodiment shown, if the voltage potential of $V_{CC}$ 311 is higher than the voltage potential of $V_{CCP}$ 309, comparator 315 generates a select signal 319 having a value of "0." Accordingly, the gate of PMOS transistor 323 receives a "0" and the gate of PMOS transistor 325 receives a "1" through inverter 327 from comparator 315. As a result, PMOS transistor 325 is switched off and PMOS transistor 323 is switched on, thereby pulling up the output voltage 321 to the voltage potential of $V_{CC}$ 311. If the voltage potential of $V_{CCP}$ 309 is higher than the voltage potential of $V_{CC}$ 311, comparator 315 generates select signal 319 having a value of "1." In this instance, PMOS transistor 323 is switched off and PMOS transistor 325 is switched on, thereby pulling up output voltage 321 to the voltage potential of $V_{CCP}$ 309. It is noted that comparator 315 and inverter 327 are powered by output voltage 321, ensuring that their high levels are high enough to switch off PMOS transistors 323 or 325.

With the gate of NMOS transistor 305 receiving the higher voltage between $V_{CC}$ 311 and $V_{CCP}$ 309, the safe signal received by the integrated circuit input buffer 307 from voltage clamp circuit 304 is ensured to be of adequate voltage to switch correctly input buffer 307. In addition, with voltage clamp circuit 304, the safe input signal received by integrated circuit input buffer 307 is ensured not to be dangerously high so as not to destroy the gate oxides of integrated circuit input buffer 307. With NMOS transistor 305, the maximum input voltage received by input buffer 307 is limited to no less than output voltage 321 minus $V_{TN}$ minus some body effect of transistor 305 and no more than output voltage 321.

Figure 4A:
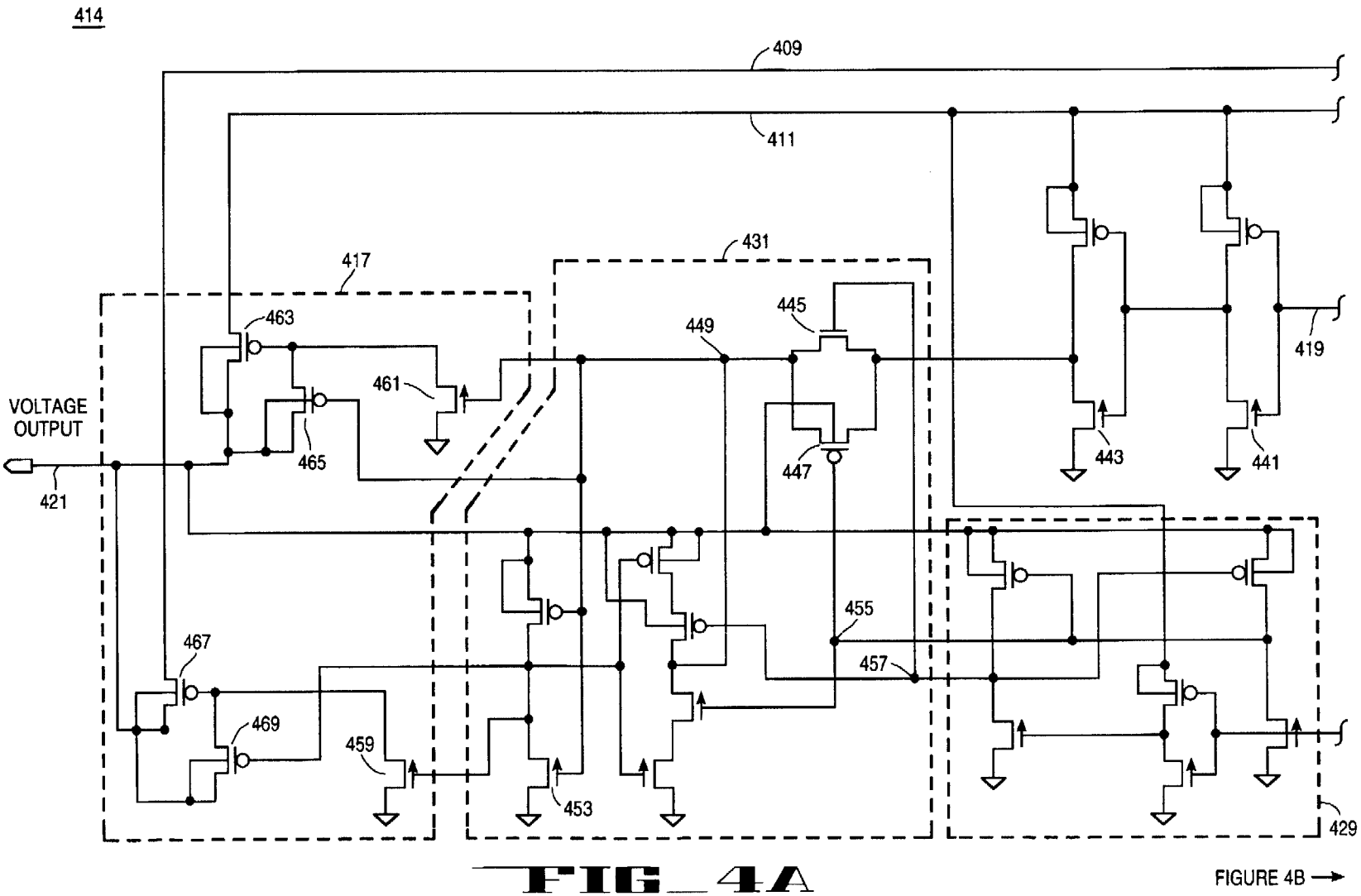
FIGS. 4A and 4B illustrate a schematic of one embodiment of a voltage selection circuit in accordance with the teachings of the present invention.
Figure 4B:
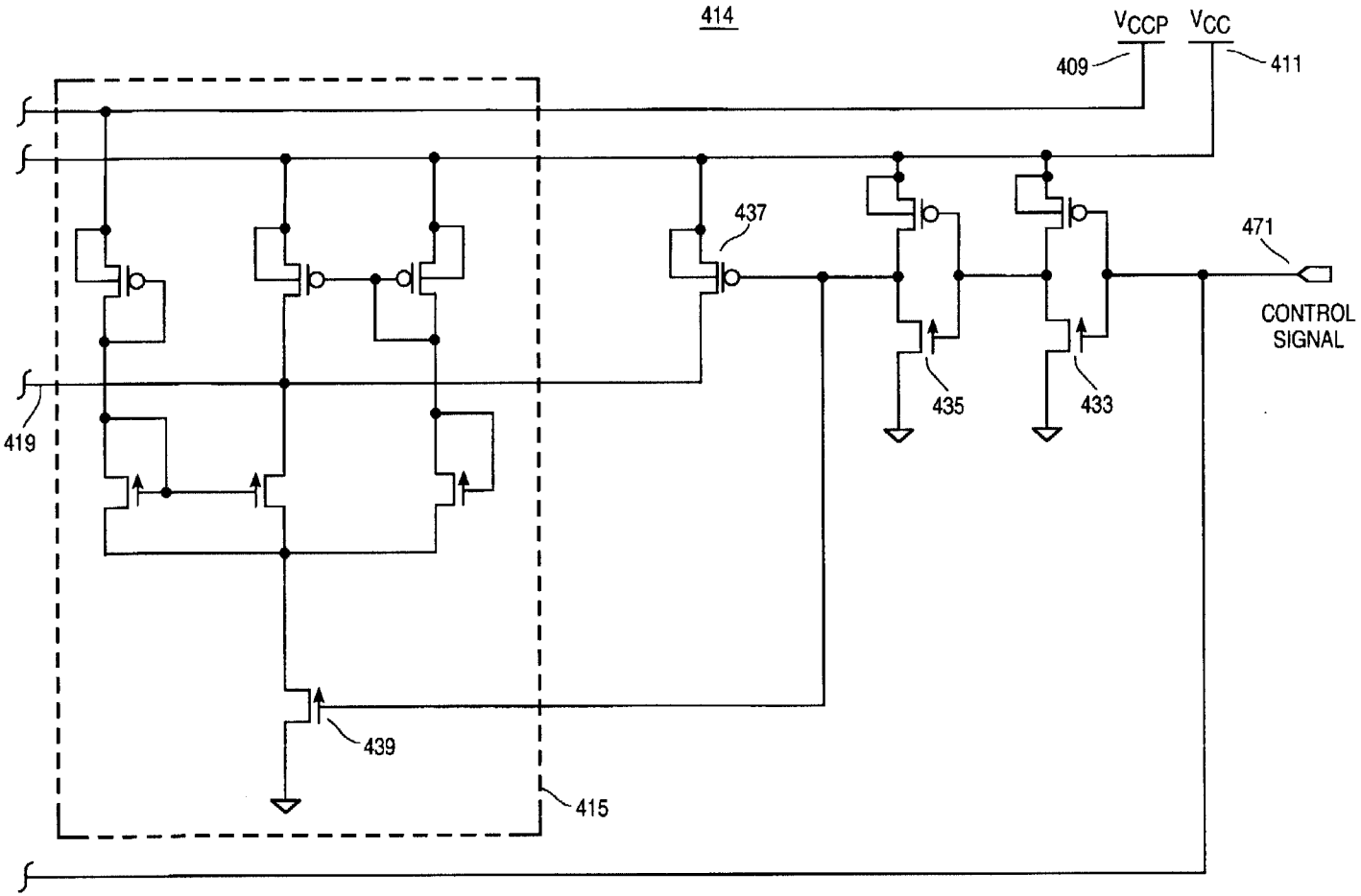

In FIGS. 4A and 4B, a detailed schematic of one embodiment of the present invention, voltage selection circuit 414, is shown. $V_{CCP}$ 409, $V_{CC}$ 411 and control signal 471 are received by voltage selection circuit 414. Voltage selection circuit 414 includes comparator 415 and multiplexor 417 and generates output voltage 421. In one embodiment, control signal 471 is a reset signal. Also included in voltage selection circuit 414 are level shifter circuitry 429 and resettable jam latch 431. In response to a reset signal, when control signal 471 equals "1," resettable jam latch 431 is in a tri-state condition and comparator 415 compares the voltage potential of $V_{CCP}$ 409 and $V_{CC}$ 411 and generates a select signal 419 indicating the higher voltage of the two. The select signal value is latched in resettable jam latch 431 and the corresponding power supply voltage is output by multiplexor 417 at output voltage 421. After reset, when control signal 471 is equal to "0," comparator 415 is deactivated and resettable jam latch 431 in conjunction with multiplexor 417 maintain the output voltage 421. With comparator 415 activated only during a reset condition, electric current and power consumption of voltage selection circuit 414 is minimized since comparator 415 is deactivated during a non-reset condition.

In particular, control signal 471 is received by voltage selection circuit 414 and is passed through inverters 433 and 435 to the gates of PMOS transistor 437 and NMOS transistor 439. During a reset condition, when control signal 471 is "1," NMOS transistor 439 is switched on and PMOS transistor 437 is switched off, thereby activating comparator 415. In the embodiment shown in FIGS. 4A and 4B, comparator 415 includes a dual current mirrored comparator. If the voltage potential of $V_{CC}$ 411 is greater than the voltage potential of $V_{CCP}$ 409, then select signal 419 is pulled high, or to a value of "1." If $V_{CCP}$ 409 is greater than $V_{CC}$ 411, then the voltage potential at select signal 419 is pulled low, or to a value of "0."

During a non-reset condition, when control signal 471 is equal to "0," then PMOS transistor 437 is switched on and NMOS transistor 439 is switched off, thereby effectively deactivating comparator 415. With transistor 439 switched off, no current or power is drawn through comparator 415 thereby minimizing power consumption.

During a reset condition, when control signal 471 is equal to "1," node 457 is pulled high, or equal to "1," and node 455 is pulled low, or equal to "0," by level shifter circuitry 429. During non-reset conditions, when control signal 471 is equal to "0," node 455 is caused to equal "1" and node 457 is caused to equal "0" by level shifter circuitry 429.

It is noted that in the embodiment shown in FIGS. 4A and 4B, control signal 471 swings between a "0" and "1," where a "1" is equal to the same voltage found at $V_{CC}$ 411. Level shifter circuitry 429 uses output voltage 421, which is the highest voltage of $V_{CCP}$ 409 and $V_{CP}$ 411, to ensure that a reset signal with a sufficiently high voltage is received and processed by the internal devices of voltage selection circuit 414. For example, assume that $V_{CCP}$ 409 is the highest voltage between $V_{CCP}$ 409 and $V_{CC}$ 411. Since a "1" received from control signal 471 has a voltage equal to only $V_{CC}$ 411, that "1" received from control signal 471 may not be sufficiently high to switch adequately the internal devices of voltage selection circuit 414. Level shifter circuitry 429 corrects the potential problem described in this example by expanding the voltage range of control signal 471 from 0 to $V_{CC}$ 411 to 0 to $V_{CCP}$ 409.

With nodes 455 and 457 equal to "0" and "1" respectively during a reset condition, transistor pair 455 and 457 are switched on thereby passing select signal 419 through inverters 441 and 443 to multiplexor 417 and resettable jam latch 431. With nodes 455 and 457 equal to "0" and "1" respectively, select signal 419 is fed down to inverter 453 of resettable jam latch 431. After the reset condition, the value of select signal 419 is latched in resettable jam latch 431 when control signal 471 is deasserted.

During a non-reset condition, when transistor pair 445 and 447 are switched off, select signal 419 is not passed through to multiplexor 417 and resettable jam latch 431. Instead, the previously determined select signal latched in resettable jam latch 431 is fed up through node 449 from resettable jam latch 431 to multiplexor 417. Therefore, voltage selection circuit 414 continuously supplies output voltage 421 without the need to compare constantly $V_{CCP}$ 409 and $V_{CC}$ 411 with comparator 415.

As described above, if it is determined that the voltage potential of $V_{CC}$ 411 is higher than the voltage potential of $V_{CCP}$ 409, then select signal 419 is equal to "1". If the voltage potential of $V_{CCP}$ 409 is higher than the voltage potential of $V_{CC}$ 411, select signal 419 is equal to "0." With a select signal of "1," a "1" is transmitted through node 449 to the gates of NMOS transistor 461 and PMOS transistor 465. Accordingly, NMOS transistor 461 is switched on while PMOS transistor 465 is switched off with NMOS transistor 461 switched on pulling the gate of PMOS transistor 463 low thereby switching on PMOS transistor 463. Accordingly, $V_{CC}$ 411 is output to output voltage 421 through PMOS transistor 463 causing output voltage 421 to be substantially equal to $V_{CC}$411. In addition, the "1" is transmitted from node 449 to inverter 453 of resettable jam latch 431. Thus, "0's" are received by the gates of NMOS transistor 459 and PMOS transistor 469.

Thus, NMOS transistor 459 is switched off while PMOS transistor 469 is switched on. With PMOS transistor 469 switched on, the gate of PMOS transistor 467 is pulled high through PMOS transistor 469 thereby switching off PMOS transistor 467 and disconnecting $V_{CCP}$ 409 from output voltage 421.

If select signal 419 is equal to "0" instead, a "0" is transmitted through node 449 to inverter 453 such that "1's" are received by NMOS transistor 459 and PMOS transistor 469. Thus, NMOS transistor 459 is switched on and PMOS transistor 469 is switched off. Accordingly, the gate of PMOS transistor 467 is pulled low through NMOS transistor 459 thereby switching on PMOS transistor 467 and establishing output voltage 421 to be substantially equal to $V_{CCP}$ 409. In addition, with the select signal 419 equal to "0," a "0" is transmitted through node 449 to the gates of NMOS transistor 461 and PMOS transistor 465. Accordingly NMOS transistor 461 is switched off while PMOS transistor 465 is switched on. Thus, with PMOS transistor 467 switched on, the gate of PMOS transistor 463 is pulled high thereby switching off PMOS transistor 463 thereby disconnecting $V_{CC}$ 411 from output voltage 421.

In the foregoing detailed description, an apparatus and a method for generating an output voltage for an integrated circuit is described. The apparatus and method of the present invention has been described with reference to specific exemplary embodiments thereof. It will, however, be evident that various modifications and changes may be made thereto without departing from the broader spirit and scope of the present invention. The present specification and drawings are accordingly to be regarded as a illustrative rather than restrictive.

What is claimed is:

1. A device for generating an output voltage for an integrated circuit comprising:

a comparator coupled to a plurality of voltage potentials and a control signal, the control signal enabling the comparator to generate a select signal in response to the plurality of voltage potentials, the comparator drawing substantially no power when not generating the select signal;

a latch coupled to the comparator and the control signal, the control signal enabling the latch to latch the select signal; and a multiplexor coupled to receive the select signal from the latch and the plurality of voltage potentials, the multiplexor generating the output voltage in response to the select signal.

2. The device described in claim 1 wherein the comparator comprises a dual current mirrored comparator.

3. A device for protecting an integrated circuit input comprising:

a voltage clamp circuit coupled to the integrated circuit input, the voltage clamp circuit coupled to receive an input signal and an output voltage, the voltage clamp generating a safe signal received by the integrated circuit input, the safe signal clamped to a voltage less than the output voltage; and a voltage selection circuit coupled to receive a plurality voltage potentials and generating the output voltage in response to the plurality of voltage potentials, the voltage selection circuit including:

a comparator coupled to the plurality of voltage potentials and a control signal, the control signal enabling the comparator to generate a select signal in response to the plurality of voltage potentials, the comparator drawing substantially no power when not generating the select signal:

a latch coupled to the comparator and the control signal, the control signal enabling the latch to latch the select signal; and a multiplexor coupled to receive the select signal from the latch and the plurality of voltage potentials, the multiplexor generating the output voltage in response to the select signal.

4. The device described in claim 3 wherein the output voltage is substantially equal to a highest one of the plurality of voltage potentials.

5. The device described in claim 3 wherein the comparator comprises a dual current mirrored comparator.

6. The device described in claim 3 wherein the voltage clamp circuit comprises a transistor coupled between the input signal and the integrated circuit input, the transistor having a gate coupled to receive the output voltage.

7. A method for protecting an integrated circuit input comprising the steps of:

enabling with a control signal a comparator to compare of a plurality of voltage potentials;

enabling with the control signal a latch to latch a select signal generated by the comparator;

disabling with the control signal the comparator from comparing the plurality of voltage potentials such that substantially no power is drawn by the comparator when disabled;

selecting one of the plurality of voltage potentials in response to the latched select signal; and clamping an input signal received by the integrated circuit in response to the selected one of the plurality of voltage potentials.

8. The method described in claim 7 wherein the select signal generated by the comparator is generated by determining the one of the plurality of voltages with a highest voltage.

9. The method described in claim 7 wherein the comparator comprises a dual current mirrored comparator.

10. The method described in claim 7 wherein the clamping step is performed with a clamp circuit, the clamp circuit comprising a transistor configured so as to receive the input signal and transmit a safe signal to the integrated circuit input, the transistor having a gate coupled to receive the selected one of the plurality of voltage potentials.

11. The method described in claim 10 wherein the safe signal is clamped to a voltage lower than the selected one of the plurality of voltage potentials.

* * * * *